US005240287A

United States Patent [19]

Nirmel

[11] Patent Number: 5,240,287

[45] Date of Patent: Aug. 31, 1993

[54] SYSTEM AND METHOD FOR ACCURATELY LOCATING AND MOUNTING OBJECTS OF KNOWN SHAPES AND SIZES TO A SUPPORTING SURFACE

[76] Inventor: Chittaranjan N. Nirmel, 1108 Portner Rd., Alexandria, Va. 22314

[21] Appl. No.: 22,459

[22] Filed: Feb. 25, 1993

Related U.S. Application Data

[60] Division of Ser. No. 749,656, Aug. 26, 1991, which is a continuation-in-part of Ser. No. 606,147, Oct. 31, 1990, Pat. No. 5,076,612.

[51] Int. Cl.[5] ..... B42D 15/00

[52] U.S. Cl. ..... 283/101; 40/158.1

[58] Field of Search ..... 283/67, 101, 70, 115, 283/117; 40/628, 630, 158.1; 428/42, 346, 352, 542.8

[56] References Cited

U.S. PATENT DOCUMENTS

| | | | |
|---|---|---|---|
| 3,517,106 | 6/1970 | Chase | 40/158.1 |
| 3,687,770 | 8/1972 | Chase | 40/158.1 |
| 3,893,252 | 7/1975 | Chase | 40/158.1 |
| 3,987,569 | 10/1976 | Chase | 40/158.1 |
| 4,057,923 | 11/1977 | Chase | 40/158.1 |
| 4,499,130 | 2/1985 | Questel et al. . | |
| 4,500,021 | 2/1985 | Bildusas . | |
| 4,530,867 | 7/1985 | Gorman . | |
| 5,076,612 | 12/1991 | Nirmel . | |

*Primary Examiner*—Mark Rosenbaum
*Assistant Examiner*—Willmon Fridie, Jr.
*Attorney, Agent, or Firm*—Chittaranjan N. Nirmel

[57] ABSTRACT

Overall shape replicates of objects of known shape and size are formed of a thin sheet material and are provided on a first side with one or more reference marks and/or apertures at positions which correspond to specific locations on the corresponding object at which support force should be provided for securely mounting the object to a supporting surface. In a preferred embodiment, the other side of each replicate is provided with a pressure-sensitive, releasable adhesive material, preferably leaving an edge portion of each replicate free of adhesive to enable temporary releasable adhesion of the replicate to the support surface. Repeatable removal of a replicate enables the user to visualize the corresponding object in harmony with other objects and/or nearby features. Once a final location for each replicate is determined, the user can apply means such as nails, screws, or the like to the support surface through the replicate, peel off the replicate, and then mount the corresponding object precisely as and where oriented and desired. The replicates may be provided with a peelable protective film covering the adhesive material until use. Replicates of standardized shape and size may be conveniently stored as pads or as an elongate roll with adjacent replicates defined and separable at lines of perforations. Optional or additional adhesion may be provided to mount a large replicate to a rough surface or under a horizontal surface by applying conventional removable adhesive tape to the replicate.

18 Claims, 2 Drawing Sheets

SYSTEM AND METHOD FOR ACCURATELY LOCATING AND MOUNTING OBJECTS OF KNOWN SHAPES AND SIZES TO A SUPPORTING SURFACE

This is a division of my co-pending application U.S. Ser. No. 07/749,656, filed on Aug. 26, 1991, which is a continuation-in-part of U.S. Pat. No. 5,076,612 which issued Dec. 31, 1991 of Ser. No. 07/606,147 filed Oct. 31, 1990.

FIELD OF THE INVENTION

This invention relates to accurate mounting of objects of known shape and size to a support surface, and more particularly to a system and a method enabling a user to visually simulate the disposition of the objects on a wall or ceiling to determine satisfactory locations for mounting individual objects.

BACKGROUND OF THE PRIOR ART

When people move into a new dwelling or office, they often want to mount to one or more walls objects such as framed pictures, diplomas or certificates of generally rectangular shape, or oddly shaped objects such as decorative clocks and the like. They may even want to mount equipment such as fans, chandeliers, or track lighting to a ceiling, or a can opener underneath a kitchen cabinet. Such objects are typically of known shape and size and have optimum locations at which they should receive support. Elements or structural features to receive such support are usually provided on the objects by the manufacturers.

It is natural to want to locate such objects harmoniously with each other and with features like windows, furniture and light switches and with areas having different textures, e.g., partially wallpapered or brick-veneered walls. Most people have trouble deciding where individual objects are best located, and usually settle on a less than totally satisfactory solution. Even with pictures of standardized shapes and sizes it is very hard to finally line them up with each other accurately and harmoniously. This happens because, even for skilled engineers, it is quite difficult to accurately locate a nail or screw to mount each object as intended. Most people use a measuring tape or a yardstick to decide where to make marks on the surface where the nails or screws are to be driven to support each object.

The objects are first individually held up and moved around by a friend or colleague, while the person trying to locate each object tries to visualize and remember how the individual objects are meant to be located. For most people, even this is a difficult task. In addition, sometimes a surface cannot be marked properly, e.g., if it is a brick-veneered wall, has flocked wall paper, or has an expensive or fragile covering such as silk or straw. Support surfaces such as ceilings may also be hard to reach or may be sloping.

Clearly there exists a need for a system and a method, for use by an average person possessing only basic tools and measuring devices and finite patience, to accurately locate and mount on various support surfaces a plurality of objects each of known shape and size. Such a person should be enabled by this invention to comfortably visualize how a number of objects will fit into their surroundings and with each other and to quickly and accurately affix elements such as nails or screws to mount the objects as desired.

SUMMARY OF THE INVENTION

Accordingly, it is a principal object of this invention, in its various embodiments, to provide easily-relocatable shape replicates of objects of known shapes and sizes, to enable a person to repeatedly relocate the replicates on one or more support surfaces, to thereby determine where to locate support forces to mount corresponding objects.

In another aspect of this invention, there is provided a method for using overall shape replicates of a plurality of objects in a repeatedly relocatable manner, to thereby enable a user to determine harmonious locations for individual objects vis-a-vis other nearby objects and structural features.

In a preferred embodiment of this invention, these and other related objects are realized by providing a device for locating an object on a supporting surface, comprising:

a thin sheet sized and shaped to serve as a lightweight shape replicate of the object; and a reference mark provided on a first side of said replicate for indicating a position on the replicate corresponding to a location on the object for applying a support force to support the object in a predetermined disposition, said replicate having a second side to be placed immediately adjacent a supporting surface in use.

In another aspect of this invention, there is provided a device for accurately mounting an object to a support surface, the object having an optimum location for receiving an external support force, the device comprising:

a thin sheet formed in shape and size to serve as a visual shape replicate of the object, having an aperture formed at a position corresponding to said optimum location on the object; and releasable adhesive means for temporarily adhering the sheet to the support surface to enable a user to decide where the object is to be mounted and to determine in correspondence with the location of the aperture the location of a support force position on the support surface.

In yet another aspect of this invention, the shape replicate formed and to be used as in the above-described aspects of the invention is itself defined on a selected portion of a thin sheet which in part is folded to also define a means for containing the object until its use.

In a related further aspect of this invention, there is provided a method for determining on a support surface a location for providing a support force for supporting an object in a predetermined disposition with respect to other objects and nearby features, comprising the steps of:

selecting a visual shape replicate of the object to temporarily simulate, at least in overall shape and size, a visible space to be occupied by the supported object on the supporting surface, said replicate having marked thereon a reference mark located in correspondence with an optimum position on the object at which a support force is optimally received by the object; and temporarily adhering said replicate to said supporting surface corresponding to a desired disposition in which said object is to be supported; and in correspondence with said reference mark on said replicate, determining on said support surface a location for providing said support force.

In another related aspect of this invention, there is provided a method for mounting a plurality of individual objects to a supporting surface, whereby said objects will be individually and collectively disposed in a harmonious relationship with respect to other nearby objects and features, each of said objects having a known location at which a support force will optimally support the same, comprising the steps of:

selecting individual shape replicates for each of said plurality of objects, each of said replicates having marked thereon a reference mark at a position corresponding to said known location on the corresponding object, said replicates each comprising a thin lightweight sheet material;

determining for each of said replicates a desired position and orientation on said supporting surface; and in correspondence with the respective reference marks of said replicates, determining specific locations on the supporting surface for providing thereat support means for supporting said objects in said harmonious relationship.

Persons of ordinary skill in the related art will undoubtedly visualize obvious variations and modifications of the disclosed invention. Considerations of clarity and conciseness preclude a detailed description of all such variations and modifications, hence only the most significant and essential features of the invention are illustrated in the drawing and described in detail.

BRIEF DESCRIPTION OF THE DRAWING

FIG. 3(B) is defined within a wall of the container.

DETAILED DESCRIPTION OF THE PREFERRED EMBODIMENTS

Figure 1A:
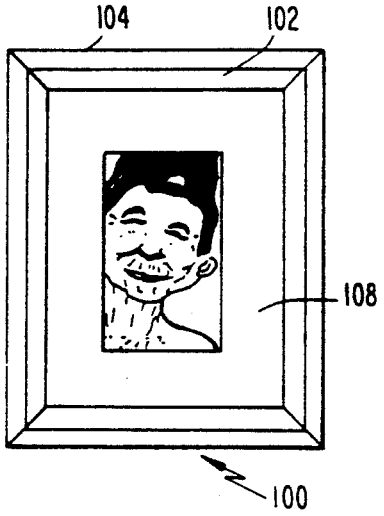
FIG. 1(A) is a front elevation view of a typical framed picture.

The preferred embodiment of this invention comprises a thin, flat sheet of a flexible material, formed to have a shape and size which replicates an object of known shape and size, to enable a user to visualize the space that such the object would occupy on a support surface. The replicate can readily be made much lighter in weight than the corresponding object. Furthermore, the material of the replicate may be paper, fabric, plastics film, cellophane or the like, which can be provided visual markings and apertures or perforations. This material may be rolled, folded, or maintained flat during storage.

One side of the replicate may be provided with markings, and selected portions of the area on an opposite side may be coated with a pressure-sensitive adhesive selected and applied to remain adhered to the replicate and to temporarily adhere the same to a supporting surface to which the replicate is pressed.

Numerous products using pressure-sensitive, readily-releasable adhesive material of suitable type are commercially available, as are the adhesive compositions themselves. Examples of products utilizing "releasable" or "removable" adhesive coatings include "Highland (TM)" brand notes in pad form, "Scotch (TM)" brand removable adhesive tape, and "Non-Stick Wall Designs" suitable for use as wall appliques in a nursery. Each of these products utilizes a removable adhesive produced by the Minnesota Mining and Manufacturing Company Details of chemical formulations for other similar adhesives, and how such adhesives may be applied, are provided in U.S. Pat. No. 4,500,021, to Bildusas and U.S. Pat. No. 4,499,130, to Questel et al., both of which are incorporated herein by reference.

Where it may be anticipated that the adhesive coating will be exposed to dust and/or dirt, a peelable covering film may be applied to the adhesive coated portions at manufacture. The user then peels off the protective coating to expose the adhesive material for use. See, for example, U.S. Pat. No. 4,530,867, to Gorman, relating to paper plates, the bottom surfaces of which are provided with adhesive material in small parallel rectangular areas and covered with a protective peelable covering. This reference is incorporated herein be reference for its teaching of such protective peelable coverings over the adhesive coating.

The term "releasable adhesive" as used herein means adhesive that remains permanently adhered to the thin sheet of which replicates are formed but which adheres only temporarily when pressed to a supporting surface and is readily releasable therefrom upon pulling of the replicate away from the supporting surface. Preferably, such an adhesive should be waterproof, odorless, applied very thinly to the replicate surface, and nontoxic. The adhesives disclosed in the references incorporated herein are all believed to qualify.

Since the replicates will ultimately be discarded after use, they may preferably be made of relatively inexpensive paper, e.g., recycled paper. Such paper may even be water absorbent, and the discarded replicates may be utilized like paper towels to clean up dirt spills.

FIG. 1(A) depicts, in front elevation view, a conventional framed picture 100 comprising a frame 102 formed of pairs of connected horizontal and vertical sections 104 and 106. Frame 102 surrounds a mat 108 defining a zone within which a picture is visibly located. A piece of flat glass or plastic (not shown) may be provided in front of the mat and the picture, and retained in place by frame 102 to protect the picture.

Figure 1B:
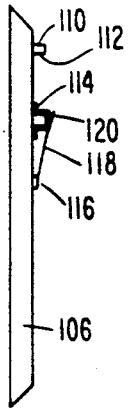
FIG. 1(B) is a side elevation view of the same framed picture.
Figure 1C:
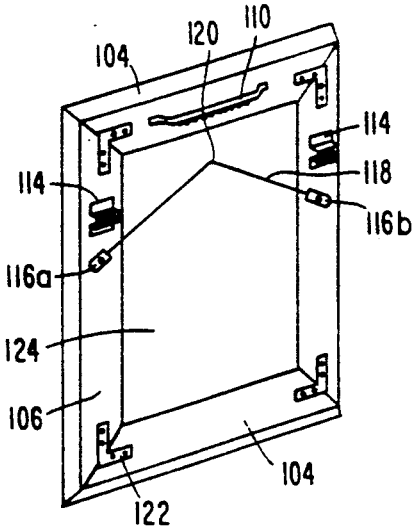
FIG. 1(C) is a rear perspective view of the framed picture, showing a variety of known elements for receiving support force to support the frame in use.

As best seen in FIGS. 1(B) and 1(C), at the back of frame 102 are one or more elements to receive a support force to mount the framed picture to a support surface. Three such means are shown in FIGS. 1(B) and 1(C), although in practice the manufacturer of the frame may typically provide only one. These three means are only exemplars, and other means may be used instead as functional equivalents.

One type of support element is a horizontal bar 110 attached at its ends to the back of the topmost horizontal section 104. Bar 110 may have one or more notches 112 formed at a lower edge. Such notches are to avoid accidental horizontal sliding movement between bar 110 and nails, screws, tacks, pins, or the like (not shown) upon which the lowest edge of bar 110 will rest. One nail or screw may suffice if the framed picture is not heavy, and more may be provided as necessary.

A modification of horizontal bar 110 may take the form of a pair of brackets 114, 114, each of which, in effect, provides a portion equivalent in function to horizontal bar 110. Thus, each of the brackets 114, 114 would have a horizontal edge with one or more notches, each of which would rest on one of two spaced apart nails or screws.

A third type of support mechanism comprises a pair of end elements 116, 116, each mounted to one of the upright sections 106, 106 of the frame, with an elongate thin member 118 connected therebetween. Elongate member 118 may be a metal wire, a chain, or a string, and has an overall length larger than a distance measured directly between the paired elements 116, 116. When elongate element 118 is hung over a nail or screw, preferably at its midpoint, it forms an angle having a peak 120 where a single support force is received. An obvious variation would be to provide two nails or screws separated horizontally, with elongate element 118 extended over both such supports. To avoid crowding FIG. 1(C), such a simple variation is not illustrated herein.

Elements such as reinforcement brackets 122 may be provided at the corners of the framed structure. Between the picture and an inside edge surface of frame 106 there may be provided a backing sheet 124, e.g., a rectangular piece of cardboard.

Manufacturers of such picture frames typically provide them in selections of standardized shapes and sizes. Furthermore, such frames are provided with elements which enable the frames to be utilized with their respective longer sides vertical or horizontal. Elements such as 110, 114 and 118 clearly can be affixed to the rear in appropriate positions and such obvious variations, being easily understood, are not illustrated.

Figure 2A:
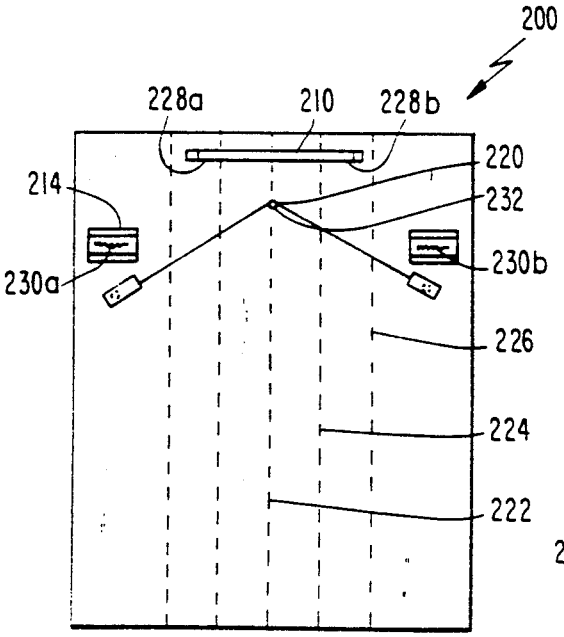
FIG. 2(A) is a front view of a shape replicate of the framed picture per FIG. 1(A)
Figure 2B:
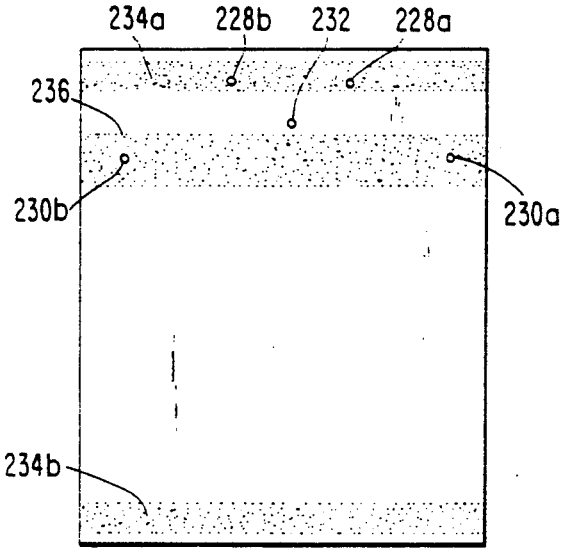
FIG. 2(B) is a rear view of the same shape replicate, according to a preferred embodiment of this invention.

As best understood with reference to FIGS. 2(A) and 2(B), a thin sheet replicate 200 may be formed to have an external shape and dimensions that match the outermost shape and dimensions of frame 102. On a front surface of replicate 200, which will be visible during use, there may be provided a variety of markings and/or apertures. Markings such as 210, 214, 216, and 218 may be printed on the first surface of replicate 200 to represent bracket 110, brackets 114, fittings 116 and elongate member 118, respectively.

To orient replicate 200 to a local vertical, there may also be provided a line 222 at the center and parallel to the longer sides, and pairs of lines such as 224 and 226 symmetrically disposed with respect to center line 222. Lines 222, 224 and 226 are shown as different types of broken lines in FIG. 2(A) for simplicity, whereas on the actual replicate they may be provided in different colors. Additional lines may be provided at right angles to these lines, i.e., parallel to the shorter sides of the replicate.

Since manufacturers of standardized frames typically provide support elements so that the frames can be used with their longest sides either vertical or horizontal, such variations can be readily accommodated on the corresponding replicates. Such details, therefore, are not illustrated in FIG. 2(A) to avoid crowding and confusion.

The most important markings on the first side of replicate 200 are those identifying optimum positions at which one or more support forces should be provided to the corresponding frame to securely mount it to a supporting surface. Although the manufacturer of frame 100 may be in the best position to identify such locations, a different entity producing replicates 200 for such a frame can by simple experiments easily determine such optimum positions for receiving the support force at a given frame 102. Such optimal locations may therefore be identified on the first surface of replicate 200, preferably by small circles to guide a user as to exactly where to drive in nails or screws into a support surface once applicate 200 has been temporarily adhered thereto as desired.

Such optimal force-application locations are indicated on replicate 200 in FIG. 2(A) as **228*a*, 228*b* (corresponding to an element such as 110), 230*a*, 230*b* (to correspond to a pair of elements such as 114), and 232 (to correspond to the apex 114 of an elongate element such as 118**). Obviously, instead of small circles like these, intersecting lines, e.g., like a "+", may be provided at the same locations.

In addition to or in place of such small circles or intersecting lines there may be provided small apertures to guide a user where to locate nails or screws to support the corresponding frame.

As best understood with reference to FIG. 2(B), selected portions of the rear surface of replicate 200 are coated with releasable adhesive material, in symmetrical bands such as **234*a*, 234*b*, which preferably do not extend to the adjacent elongate edges of replicate 200, or as one or more bands intermediate thereto, e.g., 236. Obviously, to reduce costs, continuous bands of adhesive need not be provided so long as sufficient adhesive is present to hold replicate 200** to the support surface when a substantial portion of the adhesive covered area has been pressed thereto by applying force to the visible first side of the replicate.

It is intended that a user be able to apply replicate 200 to the support surface, then peel it off to repeat the process elsewhere. Hence, sufficient adhesive must be provided to ensure that enough adherence is available to enable the user to complete the intended task even if some dirt or dust from the support surface is picked up by the adhesive in the first or second try.

Parameters for tackiness of the adhesive, the proportion of the area covered, and the like, cannot be rigidly specified since factors such as the overall size and weight of the replicate must be considered. A manufacturer of the replicate, therefore, must conduct tests and make realistic design allowances in deciding precisely how much adhesive-covered area to provide at the rear surface of each replicate. A preferred range for covering with the adhesive should be between 5 and 30% of the replicate surface area.

It is important to appreciate that since the support surface may be uneven, it is highly desirable to provide the adhesive immediately around each aperture or markings such as 228*a*, 228*b*, 230*a*, 230*b*, or 232. If a replicate is formed according to FIG. 2(B), however, so that there is ample adhesive material in bands 234*a* and 236 on opposite side of an aperture or marking such as 232, then it may not be necessary to provide adhesive material to immediately surround such an aperture or marking. Basically, what is needed is that the locations where load bearing means such as nails or screws are to be driven into the support surface be either adhered directly to the support surface or be held very close thereto by nearby adhesive.

Individual replicates can be protected by a thin film (not shown) covering the adhesive until the replicate is to be used, at which time the protective film may be peeled off.

Manufacturers of quality frames for pictures, photographs, paintings or posters typically sell them, at the point of retail sale, inside containers such as boxes formed of thin cardboard. The most convenient way to provide the appropriate replicate to the purchaser of such a frame may be to simply adhere the replicate to a correspondingly sized surface of the container. For the user's convenience, such a surface may be the back surface of a box large enough to contain the frame itself, and the user may simply peel off the replicate from the back of the box in order to use it. Unfortunately, repeated handling at the point of retail sale, and possible vandalism, may damage a replicate thus provided. An alternative, therefore, would be to adhere the replicate to the inside surface of the same wall of the container, so that the user may tear open the box and peel off the replicate for its use.

Yet another alternative would be to provide a protective coating to the adhesive covered side of the replicate and simply include the protected replicate inside the box. If the last alternative is adopted, the purchaser will be significantly helped by the presence of an undamaged replicate, ready for use upon peeling off of the protective film, with apertures or clear markings provided on the visible side of the replicate for use as already described.

The same principle applies for objects other than frames of simple shapes. The manufacturer of such replicates for objects of standardized shape and size can provide them with appropriate markings to suit various receiving elements. He may sell them to the manufacturer of the corresponding objects or may sell the replicates separately, preferably through the same retail outlets from which users purchase the objects. Large department stores that sell standard sized picture frames may thus find it convenient to provide replicates to match frames, either free or at a nominal cost, to promote sales of the frames. Owners of already purchased standard-sized frames or specific objects may want to use available replicates in the future.

Besides standardized frames for pictures, there are numerous objects, many of them three-dimensional, of known shape and size, which are sold in relatively large numbers Examples include ornamental or decorative objects made of metal, ceramic or glass, created by artists or artisans in quantities ranging from a few to hundreds. Such items often are quite expensive to the retail purchaser, hence correct mounting of such an ornamental object in harmony with other objects and nearby features is an important consideration for the purchaser. The creator of the object is in the best position to determine the optimum point at which one or more support forces should be provided to correctly mount the object. Such a party, therefore, is in the best position to create shape replicates in accordance with this invention to facilitate proper mounting of each such object.

Figure 3A:
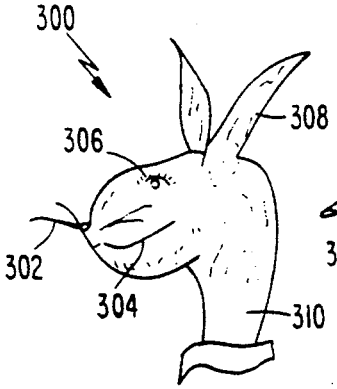
FIG. 3(A) is a front elevation view of an arbitrarily shaped three-dimensional ornamental object.

FIG. 3(A) is a vertical elevation view of an ornamental three-dimensional rabbit head. Such an object may, for example, signify membership in an exclusive social club. Object 300 has singular visible features, such as whiskers 302, a smirking smile 304, cynical eyes 306, hairy ears 308, and a long aristocratic neck 310, all of which together serve to distinguish such a rabbit head from all others. Such an object may be covered by a design patent or may have acquired secondary meaning as a trade or service mark. Since such a singular object 300 is likely to be mounted by its owner in a prominent place, its correct mounting is important and can be obtained readily by the present invention.

Figure 3B:
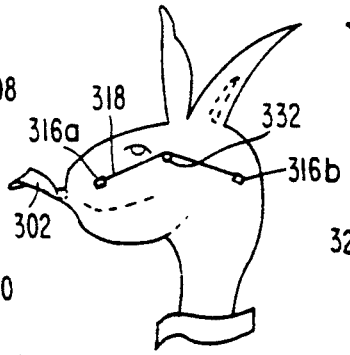
FIG. 3(B) is a front view of a shape replicate of the same object.

FIG. 3(B) depicts a shape replicate 310 of object 300. Note that since individual whiskers 302 are difficult to replicate with a thin sheet of paper or the like, a portion of replicate 310 should most conveniently have such details printed so as to be viewed by the user in deciding where and how to locate and orient the replicate on a supporting surface. Other features such as the smirking smile 304, the cynical eye 306 and hairy ears 308, as indicated, may also be visibly printed on the replicate to assist the user in precisely orienting the replicate and hence the object. Most important, on the visible surface of replicate 310 markings such as 316*a*, 316*b*, 318 and 320 may be provided to indicate where the manufacturer of object 300 has located thereon means for receiving a support force. Comparison of FIGS. 3(B) and 2(A) will show the correspondence between illustrated markings 316*a*, 316*b*, 318 and 320 with 216*a*, 216*b*, 218 and 220 respectively. Replicate 310 may also be provided with an optional aperture 332 to identify the optimum location for driving a nail or screw to provide the desired support force once replicate 310 has been located as desired on the support surface.

Figure 3C:
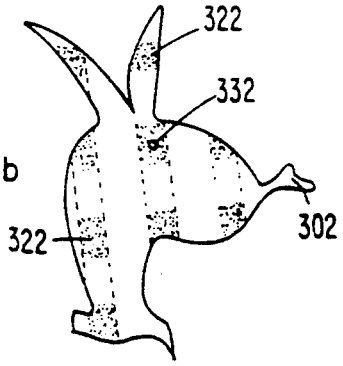
FIG. 3(C) is a rear view of the shape replicate per FIG. 3(B), according to another embodiment of this invention.

FIG. 3(C) depicts the adhesive-covered rear side of replicate 310. Note, in this example, that the adhesive is provided at a plurality of small separated areas 322, with adhesive preferably provided to immediately surround aperture 320 to ensure that this portion of the replicate will adhere to the support surface to facilitate location of load support means through aperture 332.

As was discussed with reference to frame 106, a replicate for an arbitrarily shaped object 300, optionally with a protective film adhered to the adhesive to protect it from dust and dirt, may be readily included within a box containing object 300. It may be provided in this manner already cut out to its outlined form, per FIGS. 3(B) and 3(C), or be defined at its outline by a series of easily torn perforations within a larger, e.g., rectangular sheet.

Figure 4:
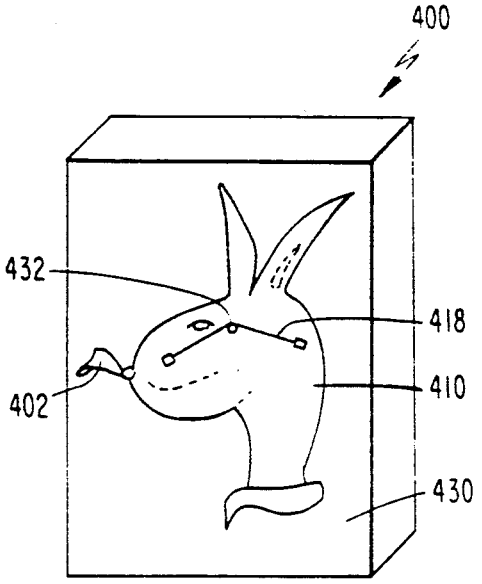
FIG. 4 is a perspective view of yet another embodiment of this invention, in the general form of a container for containing an object like the one illustrated in FIG. 3(A), wherein a shape replicate corresponding to the shape replicate per

FIG. 4 illustrates yet another embodiment by which to deliver a replicate such as 310 together with a corresponding object 300. Thus, in FIG. 4, there is illustrated a box-like container 400 large enough to accommodate an object 300 (not shown). Defined on one of the container walls 430 is a replicate 410 having features 402, 418 and 432, which correspond, respectively, to features 302, 318 and 332 in the replicate as illustrated in FIG. 3(B). Such a replicate 410 optionally may be a pre-cut replicate like 310 and be temporarily adhered to the surface of container wall 430.

In the alternative, replicate 410 may be defined as part of wall 430 by a series of closely spaced and easily tearable perforations. In the latter case, the purchaser of object 300 can tear out replicate 410 at such perforations and then use the replicate as generally described hereinabove. Container 400 need not be an entirely closed box, e.g., a portion of the container may be defined by a transparent piece of cellophane to enable the recipient or purchaser of container 400 to visually inspect the object inside to ensure that it is not cracked, broken or otherwise damaged.

Figure 5:
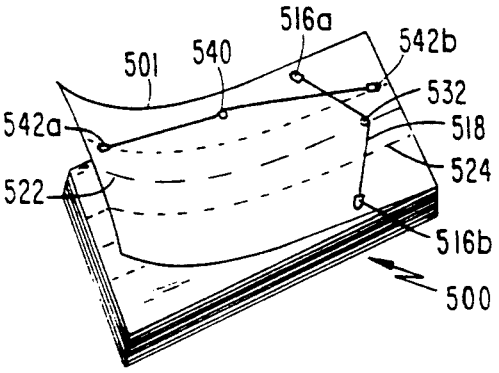
FIG. 5 is a perspective view of an assembly of shape replicates for similarly shaped and sized rectangular objects, in the form of a pad wherein adjacent replicates are adhered to each other for convenient storage pending use.

FIG. 5(A) illustrates how a pad 500 may be formed of a plurality of similarly shaped and sized replicates such as 501. A comparison may be made of replicate 501 per FIG. 5 with replicate 200 per FIG. 2(A) to appreciate the similarities therebetween. To explain a point made earlier, in FIG. 5 the uppermost replicate 501 is shown in partially peeled-away form and has on its front surface markings 542*a* and 542*b*, as well as an aperture 540 to depict features that would assist a user in locating a corresponding rectangular object with its longer sides horizontal. Also illustrated are markings 516*a* and 516*b*, 518 and aperture 532 which would enable a user to employ replicate 501 to mount a corresponding rectangular object with its longer sides vertical. Lines 522 and 524 on replicate 501 correspond generally to lines 222 and 224 on replicate 200. In essence, therefore, a plurality of replicates such as 200 can be compactly assembled into a pad such as 500, so that individual replicates may be derived therefrom as needed.

Figure 6:
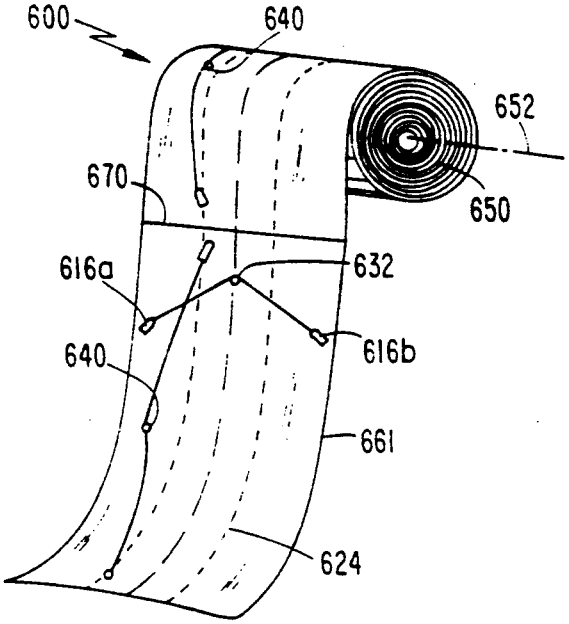
FIG. 6 is a perspective view of a plurality of shape replicates for similarly shaped and sized rectangular objects, wherein adjacent shaped replicates are defined by lines of perforations formed in a contiguous roll.

FIG. 6 illustrates another embodiment 600 of this invention, which comprises an elongate roll of a thin sheet of material provided with markings comparable to those on replicates 501 and 200, wherein immediately adjacent replicates, e.g., 661 and 662, are defined by and separable at a line of closely spaced tearable perforations 670. Each of the replicates 661, 662 and the like may have markings (recognizably numbered) which correspond to markings provided on replicate 501. Optional aperture 632 corresponds to aperture 532, aperture 640 corresponds to aperture 540, and the like. A large number of replicates may thus be conveniently stored as a roll 650 mounted to be rotatable about an axis 652 within a dispenser of known type (not illustrated for simplicity). Note that in this embodiment the dirt and dust are excluded from the rear sides of the various embodiments by the closely rolled up form of the assembly of replicates. Individual replicates may easily be torn off at perforations 670 from the roll only as needed. Techniques for forming such rolls, for wall coverings, etc., are well known.

Figure 7:
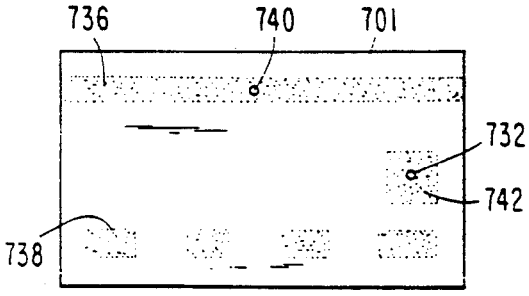
FIG. 7 is a rear view of a rectangular replicate of the type illustrated in FIGS. 5 and 6.

FIG. 7 illustrates the adhesive-covered rear side of replicates such as 501 (per FIG. 5), and 661, 662 (per FIG. 6). Purely for illustrative purposes, such a replicate 701 may be provided with adhesive applied either as a continuous band 736, or as a series of adhesive patches 738 disposed in a line or as an area of adhesive 742 immediately surrounding an aperture 732. Note that continuous pad 736 of adhesive material is preferably applied so that aperture 740 is surrounded by adhesive.

Note that to facilitate peeling off of replicates such as 501, 661 and 701, it is desirable to leave at least some of the edge portions free of adhesive material.

As will be appreciated, there may be certain types of support surfaces, e.g., a brick wall, which may be inherently dusty. This would make it difficult to repeatedly adhere thereto the type of adhesive material most suitable for use with panelling, wall paper or other smooth surfaces. For use of the shape replicates according to this invention with such inordinately dusty or rough surfaces, it may be desirable to utilize additional adhesion provided by a length of conventional removable adhesive tape disposed partly to cover the visible surface of the replicate and partly to adhere to the dusty or rough support surface.

In fact, replicates may be formed with markings and/or apertures, as described hereinabove, but with no releasable adhesive provided, ab initio, to the rear side. Adhesion as needed would be provided by ancillary adhesive means such as pieces of adhesive tape (not shown, for simplicity) which, in part, would cover the visible front surface of the replicate and in part cover and adhere to the dusty or rough surface. In certain embodiments of this invention, therefore, adhesion may be provided by such separate means rather than by or in addition to adhesive material provided on selected portions of the rear surface of the replicate. U.S. Pat. No. 4,105,224, to Rodebaugh et al., discloses a note pad structure comprising a plurality of generally rectangular note pad sheets each of which is provided along one edge with a precut adhesive tape a part of which adheres to a front surface of an individual sheet and a part of which, upon removal from the pad, is available to adhere that sheet to a support surface. Replicates according to the present invention, if utilized in this form, would include markings and one or more apertures by which a user would determine the correct location for providing support to a corresponding object. U.S. Pat. No. 4,105,224 is, therefore, incorporated herein by reference for its relevant teaching as described.

My copending application U.S. Ser. No. 07/606,147, filed on Oct. 31, 1990, discloses a system and a method by which a user may take individual objects of arbitrary shape and even of relative large size and create corresponding replicates to be used in the same manner as the replicates described herein on substantially vertical surfaces. There is, however, yet another situation, involving objects of known shape and size which often are mounted to inclined support surfaces or are mounted to depend downwardly from substantially horizontal surfaces. Examples of such objects include relatively large ceiling fans and chandeliers which are mounted to inclined or horizontal portions of ceilings in, for example, restaurants, vacation cabins and the like. Other objects such as, for example, can openers, small microwave ovens, and the like, are typically mounted underneath wall-mounted kitchen cabinets. The present invention is particularly useful in helping mount such objects accurately. The essential aspects of replicates for this purpose and their manner of use are substantially as described.

The manufacturer of a chandelier, for example, would know precisely where supporting screws or bolts must be located to support the uppermost portion of the chandelier and, therefore, can readily form and provide a replicate which has markings or apertures to identify such locations on a relatively large replicate picturing the chandelier itself to assist the user. The same is true of manufacturers of large ceiling fans, under-the-cabinet can openers, and the like. The only possible difference with respect to the above-described features and manner of use of the replicates may be that if the replicate, e.g., for a chandelier, is relatively large, then additional adhesion may have to be provided with the use of adhesive tape or the like as generally described earlier. In other words, the replicate with its own removable adhesive supplemented by additional releasable adhesive tape as required would then be releasable adhered to the supporting surface (which may be horizontal or inclined), and removed and moved around until a final location is determined. Since it would be visually replicating a corresponding large and heavy object, the user of the replicate is thus spared the difficulty of moving around the actual object in determining the best location for it. With the replicate, using the markings and/or apertures provided as described, the user can easily determine on a supporting surface the optimum locations for providing the desired support force. This may involve the forming of marks on the support surface through the aperture in the replicate, and forming of holes therein to receive known kinds of plugs for retaining relatively large screws passing in part through uppermost portions of the object, e.g., the mounting hub of a ceiling fan or a chandelier.

Persons of ordinary skill in the art, upon understanding the above disclosure, should be able to form and/or use replicates for a variety of objects and/or support situations. Note that because the replicates taught herein are made of thin flexible material they are readily usable with curved surfaces, e.g., pillars, concave curved walls, and the like, and are not limited to only flat or continuous surfaces. Thus, for example, a pre-cut replicate of an arbitrarily shaped object to be mounted to a fence-like structure can be utilized very effectively and would spare a user having to struggle with a heavy object itself while trying to determine where best to mount it.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A system including an object to be located and mounted to a supporting surface in a selected disposition with respect to other objects and features near the supporting surface, comprising:

an object of predetermined shape and size, having a rear side to be placed adjacent the supporting surface in use;

object support means disposed at a predetermined location at said rear side of the object for receiving a support force to support the object; and a thin sheet sized and shaped to serve as a lightweight shape replicate of the object, a first side of the replicate having a reference mark corresponding to the predetermined location on the object for providing the support force thereat when the replicate is placed in the selected disposition on the supporting surface.

2. The system according to claim 1, further comprising: pressure sensitive adhesive provided at selected portions of a second side of the replicate to facilitate temporary adherence of the replicate to the supporting surface.

3. The system according to claim 2, further comprising:

removable protective means cooperating with said shape replicate to protect said adhesive until said replicate is to be applied to the supporting surface.

4. The system according to claim 1, further comprising:

surface support means, positioned at the supporting surface in correspondence with said reference mark when the replicate is adhered to the supporting surface in said selected disposition, for providing said support force to the object support means to support the object in said selected disposition.

5. The system according to claim 2, wherein:

an edge portion of the second side of the replicate is free of adhesive.

6. The system according to claim 3, further comprising:

surface support means, positioned at the supporting surface in correspondence with said reference mark when the replicate is adhered to the supporting surface in said selected disposition, for providing said support force to the object support means to support the object in said selected disposition.

7. The system according to claim 3, wherein:

an edge portion of the second side of the replicate is free of adhesive.

8. The system according to claim 6, wherein:

an edge of the second side of the replicate is free of adhesive.

9. The system according to claim 1, further comprising:

the replicate is contiguous with an additional expanse of the thin sheet which is disposed to provide containment to the object until the replicate is used to locate the object.

10. The system according to claim 9, wherein:

the replicate is defined with respect to the additional expanse of the thin sheet by a plurality of perforations.

11. The system according to claim 10, further comprising:

a full-size elevation view of the object depicted on the first side of the replicate.

12. The system according to claim 11, further comprising:

pressure sensitive adhesive provided at selected portions of a second side of the replicate to facilitate temporary adherence of the replicate to the supporting surface.

13. The system according to claim 11, further comprising:

removable adhesive means for temporarily adhering to replicate to the support surface.

14. A system for framing, locating and mounting an object on a supporting surface in a selected disposition with respect to other objects and features near the supporting surface, comprising:

a frame of predetermined shape and size for framing the object, the frame having a rear side to be placed adjacent the supporting surface in use;

frame support means disposed at a predetermined location at said rear side of the frame for receiving a support force to support the frame; and a thin sheet sized and shaped to serve as a lightweight shape replicate of the frame, a first side of the replicate having a reference mark indicative of an optimum position for locating said support force when said replicate is placed in said selected disposition on the supporting surface.

15. The system according to claim 14, further comprising:

pressure sensitive adhesive provided at selected portions of a second side of the replicate to facilitate temporary adherence of the replicate to the supporting surface.

16. The system according to claim 15, further comprising:

removable protective means cooperating with said shape replicate to prevent exposure of said adhesive to dust or dirt until said replicate is to be applied to the supporting surface.

17. The system according to claim 14, further comprising:

surface support means, positioned at the supporting surface in correspondence with said reference mark when the replicate is adhered to the supporting surface in said selected disposition, for providing said support force to the frame support means to support the frame in said selected disposition.

18. The system according to claim 15, wherein:

an edge portion of the second side of the replicate is free of adhesive.

* * * * *